US005826457A

United States Patent [19]

Eagles

[11] Patent Number: 5,826,457

[45] Date of Patent: Oct. 27, 1998

[54] WHEEL FOR MANDREL OF PIPE STRAIGHTENING PRESSES

[76] Inventor: Allen S. Eagles, 11014 Koerner Rd., Woodburn, Oreg. 97071

[21] Appl. No.: 891,537

[22] Filed: Jul. 11, 1997

[51] Int. Cl.[6] ..... B21D 39/20

[52] U.S. Cl. ..... 72/392; 72/370.08

[58] Field of Search ..... 72/370.01, 370.05, 72/370.07, 370.08, 392, 393, 398, 447, 448, 101

[56] References Cited

U.S. PATENT DOCUMENTS

| | | | |
|---|---|---|---|
| 1,623,657 | 4/1927 | Brown . | |
| 2,687,763 | 8/1954 | Perkins . | |
| 2,780,122 | 2/1957 | McCown . | |
| 2,780,271 | 2/1957 | Ewart et al. | 72/393 |
| 3,030,901 | 4/1962 | McConnell | 72/370.08 |
| 3,109,477 | 11/1963 | Avera et al. | 72/393 |
| 3,466,921 | 9/1969 | Steiniger . | |
| 3,581,546 | 6/1971 | Ragettli . | |
| 3,585,701 | 6/1971 | Stary . | |
| 3,710,609 | 1/1973 | Jones . | |
| 3,754,720 | 8/1973 | Gross et al. . | |
| 3,817,079 | 6/1974 | Priester . | |
| 4,004,444 | 1/1977 | Pollart . | |
| 4,263,713 | 4/1981 | Smith et al. . | |
| 4,308,736 | 1/1982 | Lowe et al. . | |
| 4,475,373 | 10/1984 | Ikenberry . | |
| 4,862,724 | 9/1989 | Haws . | |
| 4,930,338 | 6/1990 | Tokura . | |
| 4,949,569 | 8/1990 | Young et al. . | |

FOREIGN PATENT DOCUMENTS

| | | | |
|---|---|---|---|
| 161225 | 11/1957 | Sweden | 72/101 |

*Primary Examiner*—Lowell A. Larson
*Attorney, Agent, or Firm*—Gregory T. Kavounas

[57] ABSTRACT

A pipe straightening press is provided with a wheel coupled to its underside. The wheel protrudes below the lowest point of the outer surface of the lower mandrel jaw when the mandrel is contracted, but does not so protrude when the mandrel is expanded. This way the wheel allows rolling the mandrel for positioning within the pipe, but does not interfere with straightening it. In the first embodiment the wheel is rollable around an axle that is fixedly attached to the support arm. The contracted mandrel expands by lowering the lower jaw, which thus lifts the support arm and the wheel with it. In the second embodiment the wheel is located within the mandrel, is fixedly attached to the upper jaw, and protrudes through an opening in the outer surface of the lower jaw only when the mandrel is contracted. In the third and preferred embodiment, the wheel is coupled to the mandrel, and biased downwards and out of the lower jaw by the upper jaw acting on the wheel axle through a spring. The spring is strong enough to lift the mandrel by a lever action, but weak enough to give way in response to a sudden impact.

4 Claims, 4 Drawing Sheets

WHEEL FOR MANDREL OF PIPE STRAIGHTENING PRESSES

BACKGROUND OF THE INVENTION

1. Field of the invention

The present invention is related to the field of pipe straightening presses used to straighten out flexible irrigation pipes that have been bent or dented.

2. Description of the prior art

Irrigation of large areas is accomplished with long pipes that are made from thin aluminum for various reasons. The pipes are therefore flexible, and over time become bent at some points by accidents or mishandling. A number of shape restoring presses have been proposed to straighten out such pipes, and thus extend their useful life.

A pipe straightening press 20 in the prior art is shown in FIG. 1. The press comprises a mandrel 22 that is attached to the end of a long support arm 24. The mandrel comprises an upper jaw 26 and a lower jaw 28, each being substantially hollow, with a continuous curved outer surface. Additional mandrel structure (not shown in FIG. 1) is located within the jaws, and couples them to each other and to the support structure. When the jaws are contacting each other the mandrel is said to be in its contracted state. The contracted mandrel is inserted in pipe 30 through mouth 32, whose rim 33 may feature a lip 34. The mandrel is then moved by the support arm into the pipe in the direction of arrow 35, up to a point 36 where the pipe is bent.

The mandrel is moved with respect to the pipe in one of two ways. The pipe may be held stationary, and the mandrel be moved within it. Alternately, the mandrel can be held stationary by attaching the other end of the support arm to fixed structure.

Once at that point, the mandrel is stopped and expanded by a remotely effectuated lateral translation of the jaws with respect to each other, as seen in FIG. 2. There are various mechanisms for accomplishing this. According to the mechanism of FIG. 2, the jaws of mandrel 22 are connected by jointed cams 40. A pull rod 42 is parallel to support member 24, located substantially within it, and can be pushed in or pulled out relative to it from a large distance away from the mandrel. When it is pushed in, it pushes on the joints of the cams to drive the jaws away from each other.

When the mandrel is expanded, the outer surfaces of the jaws fit matingly in the interior walls of the pipe and push against them, which straightens out the pipe at point 36. After that the mandrel is contracted again to be moved to another point with a bend, or withdrawn from the pipe if there are no other such points.

A problem with this press is that pushing the heavy mandrel within the pipe is done against friction of the lower jaw against the interior wall of the pipe. This requires a lot of strength and thus causes fatigue to the operator over a long time, as the pipes are typically 40 feet long, and can be bent at any point within that length. A fatigued operator will have diminished productivity. In addition, the friction shortens the useful life of the mandrel and of the pipe being repaired.

A solution to this problem has been to use a machine to move the mandrel with respect to the pipe. This, however, does not prevent the wear and tear of the mandrel and the pipe that result from their friction against each other.

BRIEF SUMMARY OF THE INVENTION

The present invention overcomes the problems and limitations of the prior art.

Generally, the present invention provides a pipe straightening press with a wheel coupled to act on the underside of the press. The wheel protrudes below the lowest point of the outer surface of the lower mandrel jaw when the mandrel is contracted, but does not so protrude when the mandrel is expanded. This way the wheel allows rolling the heavy mandrel for positioning within the pipe, but does not interfere with straightening the pipe.

In the first embodiment of the invention, the wheel is rollable around an axle that is fixedly attached to the support arm. The upper jaw of the mandrel is fixedly attached to the support arm. When the mandrel is contracted, the wheel protrudes below the outer surface of the lower jaw. When the mandrel is expanded, the lower jaw lifts the support arm and the wheel with it.

In the second embodiment of the invention, the wheel is located within the mandrel, is fixedly attached to the upper jaw, and protrudes through an opening in the outer surface of the lower jaw only when the mandrel is contracted.

In the third and preferred embodiment, the wheel is coupled to the mandrel, and biased downwards and out of the lower jaw by the upper jaw acting on the wheel axle through a spring. The spring is strong enough to lift the mandrel by a lever action, but weak enough to give way in response to a sudden impact. Accordingly, when the press is shoved into the mouth of a pipe, the rim hits the wheel, but the spring allows the wheel to be temporarily pushed in the interior of the mandrel, thus absorbing the impact. This eliminates the requirement that the mandrel be additionally lifted for the wheel to clear the rim.

It will be appreciated that the invention works regardless of how the mandrel is moved with respect to the pipe. This and other advantages of the present invention will be understood and more appreciated after a consideration of the following drawings and the detailed description of the invention.

DETAILED DESCRIPTION OF THE INVENTION

As has been mentioned, the present invention provides a pipe straightening press with a wheel coupled to act on the underside of the press. The wheel is coupled in such a way that it accomplishes a dual goal.

First, when the mandrel is in the contracted state, the wheel protrudes below the lowest point of the outer surface of the lower jaw. This enables moving the press easily within the pipe, as the wheel rolls freely.

Additionally, when the mandrel is in the expanded state, the wheel no longer protrudes below any point of the outer surface of the lower jaw. This way it does not interfere with the process of straightening out the pipe.

The wheel is rollable around an axle that is preferably short. In this description, coupling of the wheel means actually coupling the wheel axle. A person skilled in the art will be able, in view of the present description, to discern many ways of coupling the wheel to a press in order to accomplish the dual goal of the present invention.

Further in the present description, the mandrel is described as being moved, while the pipe is described as being stationary. Such movement of the mandrel is understood to be movement of the mandrel with respect to the pipe. It is entirely possible to accomplish such movement by holding the mandrel stationary, and moving the pipe only.

Figure 3:
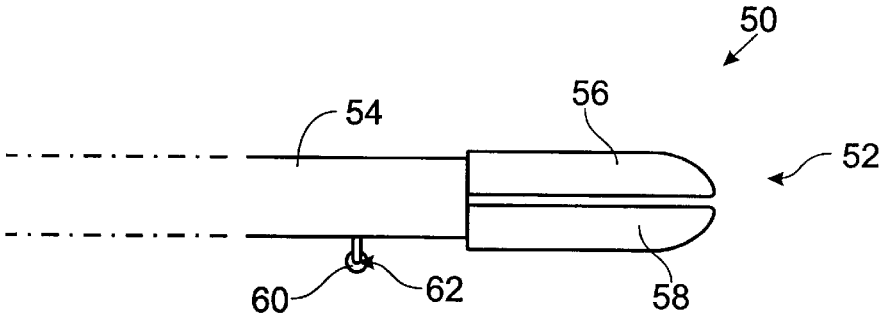
FIG. 3 is a side view of a pipe straightening press according to a first embodiment of the invention, with the mandrel in the contracted state.
Figure 4:
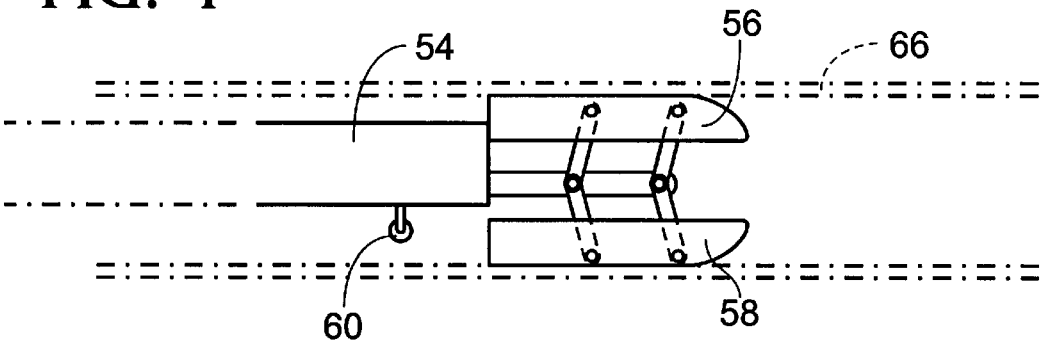
FIG. 4 is a side view of the press of FIG. 3, with the mandrel in the expanded state.

A first embodiment of the invention is now described with reference to FIGS. 3 and 4. In FIG. 3, press 50 comprises a mandrel 52 being attached to the end of a long support arm 54. The mandrel is expandable to an expanded state and contractible to a contracted state by respectively opening and closing jaws 56 and 58.

A wheel 60 is rollable about a short axle 62. The axle is attached to the underside of the support arm, and in such a distance that the wheel protrudes below the lower jaw 58 when the mandrel is in the contracted state. Further, it does not protrude this way when the mandrel is in the expanded state, as seen in FIG. 4. Indeed, to straighten pipe 66, the lower jaw lifts the rest of the mandrel, the support arm, and the wheel with it.

To improve the structural stability of the press, it is preferred that one of the jaws be fixedly attached to the support arm. For the first embodiment, it is imperative that the lower jaw be movable with respect to the support arm, and thus can not be fixedly attached to it. Therefore the upper jaw is preferably thus attached.

A second embodiment of the invention is now described with reference to FIGS. 5, 6 and 7. There the outer surface of the lower jaw has a small opening, and the wheel is coupled to the mandrel in such a way that it protrudes through the opening when the mandrel is in the contracted state, and does not so protrude when it is in the expanded state.

Figure 5:
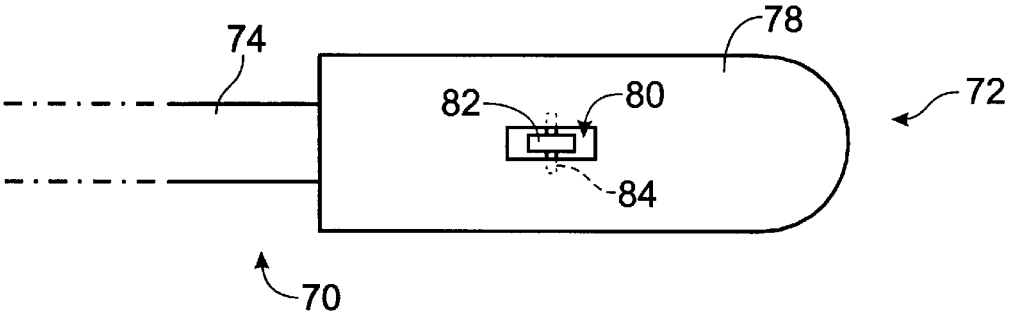
FIG. 5 is a bottom view of a pipe straightening press according to a second embodiment of the invention.

As seen particularly in FIG. 5, the press comprises a mandrel 72 at the end of a long support arm 74. The outer surface of lower jaw 78 has an opening 80. Wheel 82 is supported by a short axle 84 in such a way that it can roll around it, and protrude through opening 80 when the jaws are brought close to each other.

Figure 6:
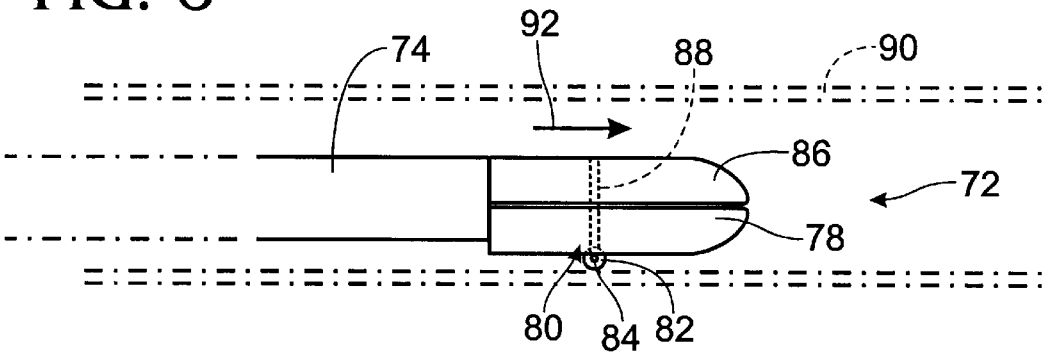
FIG. 6 is a side view of the press of FIG. 5, with the mandrel in the contracted state.

As seen in FIG. 6, axle 84 is fixedly attached to the inside of upper jaw 86 by vertical member 88, or other equivalent structure. Attachment is such that wheel 82 protrudes at least partly through opening 80 when mandrel 72 is contracted. This way the whole structure can be rolled within irrigation pipe 90 according to the direction of arrow 92.

Figure 7:
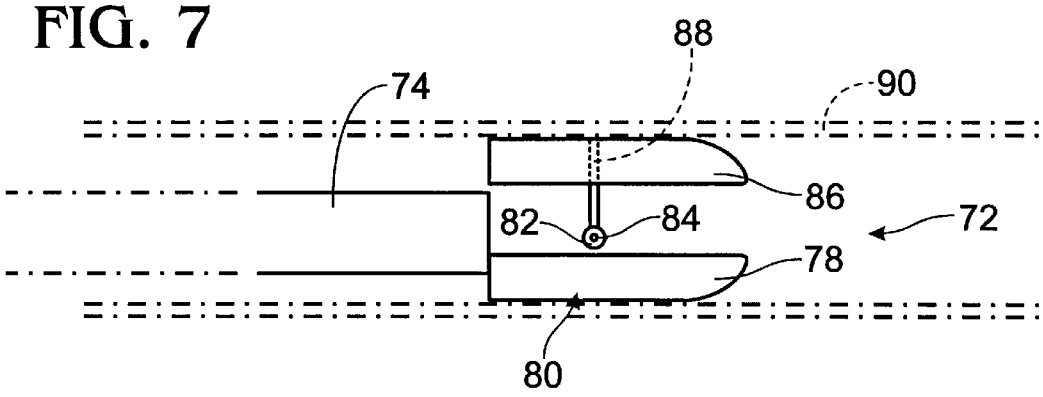
FIG. 7 is a side view of the press of FIG. 6, with the mandrel in the expanded state.

FIG. 7 shows mandrel 72 in its expanded state; however, the mechanism for expanding it is not shown so as not to complicate the drawing unnecessarily. Given the design, expanding the mandrel automatically lifts wheel 82, withdrawing it from the opening. This way the wheel does not interfere with straightening of pipe 90.

It can now be appreciated why the second embodiment is preferred to the first. First, the mandrel is heavy, and located at the tip of the long support arm. In principle, it is preferred to incorporate the wheel at the end of such structure, which is the mandrel, not the support arm. Additionally, in the second embodiment it is possible to have lower jaw 78 fixedly attached to the support arm, as opposed to having the upper jaw thus attached. Accordingly, less energy is required to straighten out the pipe, because the mechanism that separates the jaws for expanding the mandrel need not work to also lift the support arm.

Figure 8:
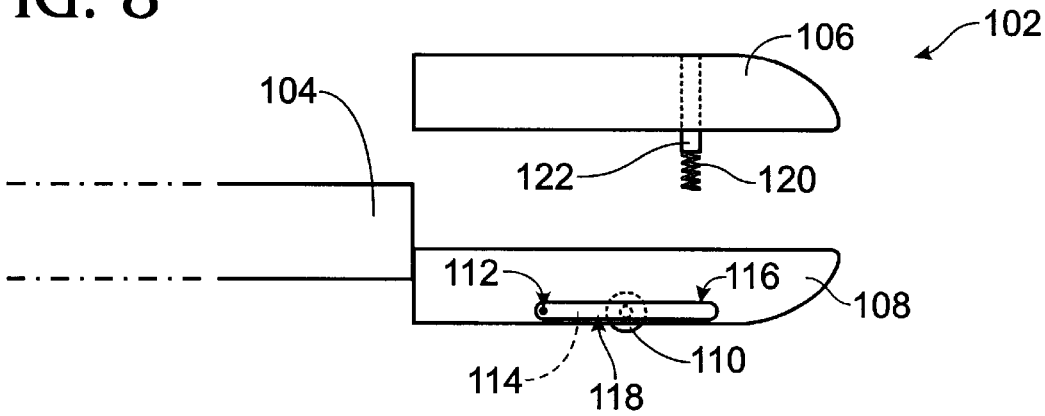
FIG. 8 is a side view of a pipe straightening press according to the preferred embodiment of the invention.

A third embodiment of the invention is now described with reference to FIG. 8. The third embodiment is the preferred embodiment because it improves on how the wheel is coupled to the mandrel.

The third embodiment again provides a mandrel 102 coupled to the end of a long support arm 104. The mandrel has two jaws 106, 108, of which lower jaw 108 is fixedly attached to support arm 104. A wheel 110 is freely pivotable around suspension point 112 of the lower jaw by means of a lever 114. Lever 114 has a surface 116 at the end away from the suspension point. When the lever is pivoted to one extreme of its travel, wheel 110 protrudes partially through an opening 118 that is similar to opening 80 of FIG. 5. The pivoting action of the lever permits the wheel to be pushed completely away from the opening and into the lower jaw with only enough force to overcome the weight of the wheel, when the lever is unobstructed.

A spring 120 is coupled to upper jaw 106, preferably by means of a projection 122. When the mandrel is in the expanded state the spring does not reach the lever. The spring is aimed so that it contacts surface 116 of the lever when the wheel protrudes from the opening and the mandrel is contracted. Then spring 120 biases lever 114 downwards, thereby indirectly biasing the wheel out of the opening. The spring biases the wheel with such force that the wheel maintained out of the opening while the mandrel is rolled within a pipe in its contracted state, but it recedes momentarily when the wheel is subjected to a sudden impact, such as when the contracted mandrel is first inserted in pipe, and the protruding wheel is hit by the rim of the mouth.

Alternately, the spring can be attached directly to the lever, and be pushed downwards by action of the upper jaw. In either case, surface 116 can have a well for containing the spring as it is bent.

Figure 1:
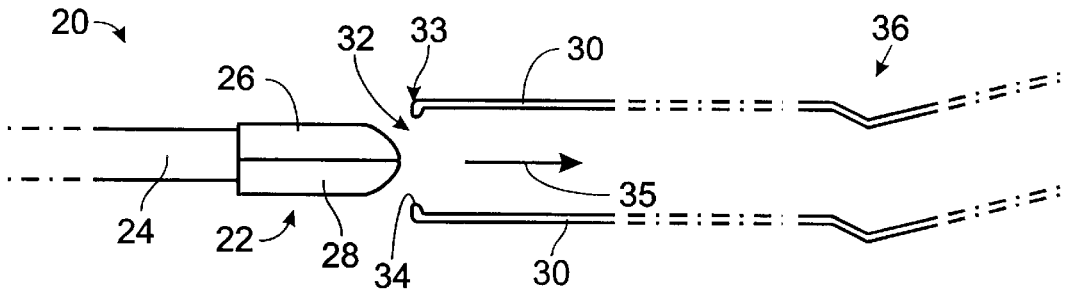
FIG. 1 (PRIOR ART)
FIG. 1 is a side view of a pipe straightening press in the prior art and a bent irrigation pipe.
Figure 2:
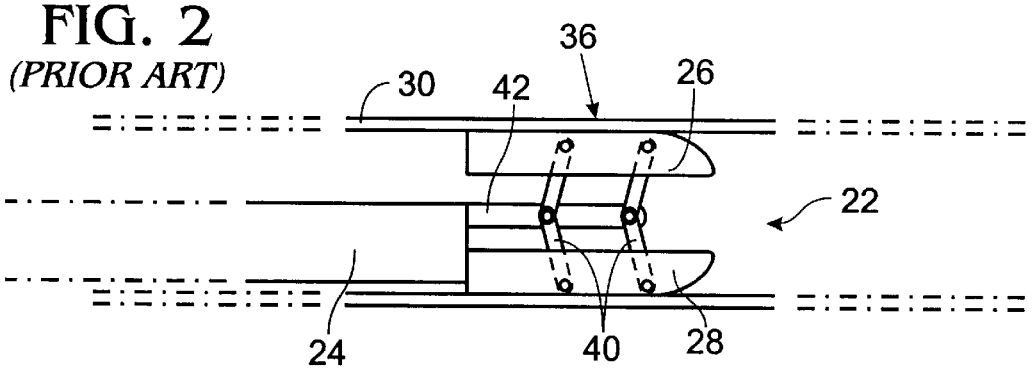
FIG. 2 (PRIOR ART)
FIG. 2 is a side view of the press of FIG. 1 straightening out the bent pipe of FIG. 1.

The advantage conferred by spring 120 is now described with reference to FIGS. 9, 10 and 11. These FIGS. illustrate successive stages of the preferred embodiment of the invention being initially pushed into mouth 132 of a pipe 130. It will be appreciated that the spring action would be the same if rim 133 of mouth 132 had a lip similar to lip 34 seen in FIG. 1.

Figure 9:
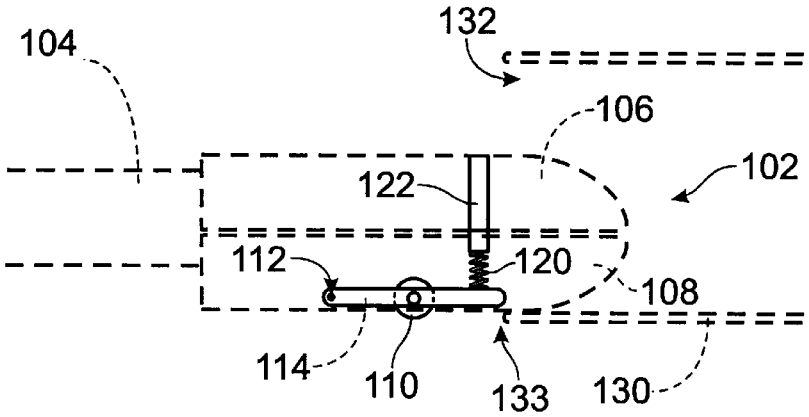
FIGS. 9, 10 and 11 are side views of the press of FIG. 8 illustrating successive stages of the position of a wheel and the action of a spring as the press is being pushed into the mouth of an irrigation pipe.

In FIG. 9, the front end of mandrel 102 has been inserted into the mouth and pushed in a little. Lever 114 is forced downwards by the weight of wheel 110 and by the force of spring 120.

Figure 10:
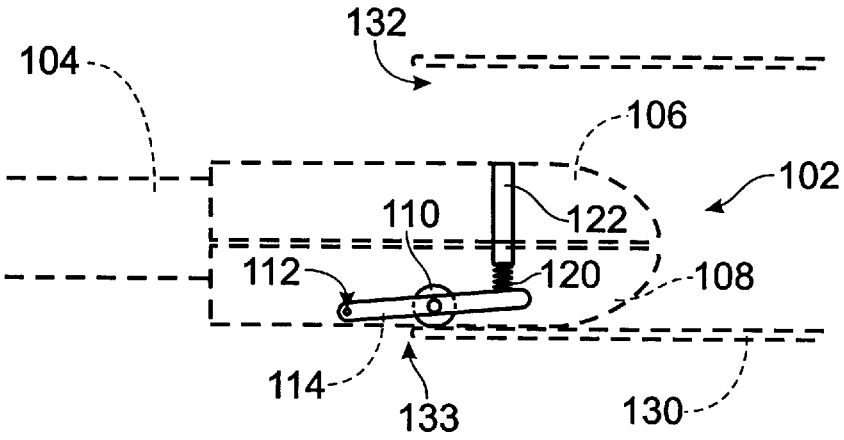

In FIG. 10 the mandrel has been forced into pipe 130 long enough so that rim 133 has impacted wheel 110. Momentarily, then, lever 114 has been lifted, while spring 120 has given way.

Figure 11:
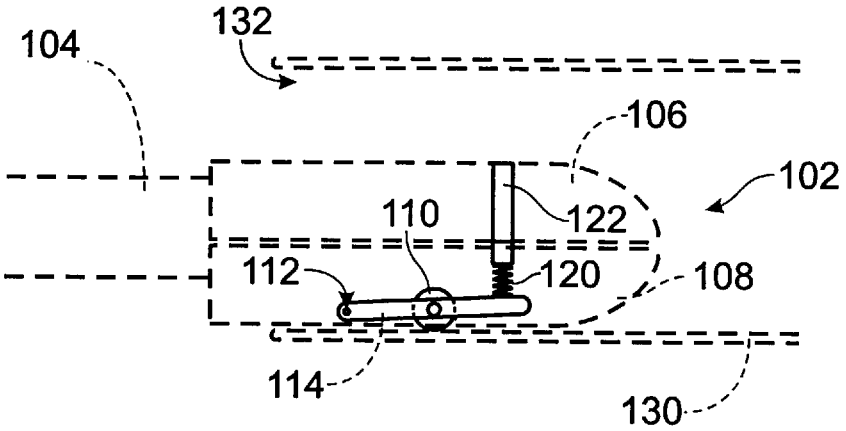

In FIG. 11 mandrel 102 has been pushed in a little more. Spring 120 has pushed lever 114 down, and wheel 110 out of the opening, thereby lifting the entire mandrel. The press is then ready to be rolled into pipe 130 up to a point of bend.

Figure 12:
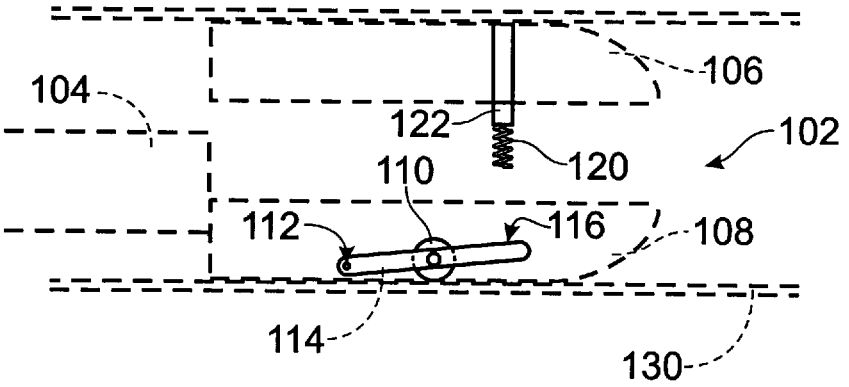
FIG. 12 is a side view of the press of FIG. 8 illustrating the position of a wheel and the action of a spring of the press when the mandrel is expanded.

FIG. 12 shows the preferred embodiment of the press in the expanded state. Spring 120 no longer biases lever 114 by flat area 116. The inner wall of pipe 130 has rotated lever 114 by pushing wheel 110 into the opening.

In the present description numerous details have been set forth in order to provide a more thorough understanding of the present invention. It will be obvious, however, to one skilled in the art that the present invention may be practiced without these specific details. In other instances, well known features have not been described in detail in order to not obscure unnecessarily the present invention.

The invention claimed is:

1. A pipe straightening press comprising a support arm and a mandrel coupled to an end of the support arm, the mandrel comprising an upper jaw and a lower jaw that can be laterally translated with respect to each other, the lower jaw having an outer surface, the mandrel being said to be in its contracted state when the jaws are accordingly close to each other, the mandrel being said to be in its expanded state when the jaws are accordingly far from each other, the mandrel capable of being inserted in a stand alone irrigation pipe and straightening the pipe when the jaws are moved such that the mandrel is changed from its contracted state to its expanded state, the press further comprising:

a wheel coupled to the press in such a way that when the mandrel is in the contracted state the wheel protrudes below the lowest point of the outer surface of the lower jaw and can roll, and when the mandrel is in the expanded state within the pipe the wheel does not protrude below the outer surface of the lower jaw; and an opening in the outer surface of the lower jaw, and wherein the wheel is coupled to the mandrel in such a way that when the mandrel is in the contracted state, the wheel protrudes through the opening, and when the mandrel is in the expanded state within the pipe, the wheel does not protrude through the opening.

2. The press of claim 1, wherein the wheel is rollable around an axle, and the axle is fixedly attached to the upper jaw.

3. The press of claim 1, wherein the wheel is coupled to the mandrel such that when the mandrel is within the pipe and is taken from the contracted state to the expanded state, the interior wall of the pipe pushes the wheel through the opening into the mandrel.

4. The press of claim 1, wherein the wheel is rollable around an axle, and the upper jaw biases the axle through a spring when the mandrel is in the contracted state.

* * * * *